United States Patent [19]

Wu

[11] Patent Number: 4,814,785

[45] Date of Patent: Mar. 21, 1989

[54] WIDEBAND GRIDDED SQUARE FREQUENCY SELECTIVE SURFACE

[75] Inventor: Te-Kao Wu, Rancho Palos Verdes, Calif.

[73] Assignee: Hughes Aircraft Company, Los Angeles, Calif.

[21] Appl. No.: 148,312

[22] Filed: Jan. 25, 1988

[51] Int. Cl.[4] ..... H01Q 15/02; H01Q 15/10

[52] U.S. Cl. ..... 343/909; 333/202

[58] Field of Search ..... 333/202, 204; 343/909, 343/753

[56] References Cited

U.S. PATENT DOCUMENTS

| | | | |
|---|---|---|---|
| 3,148,370 | 9/1964 | Bowman | 343/909 X |
| 4,656,487 | 4/1987 | Sureau et al. | 343/909 |
| 4,743,919 | 5/1988 | Chang et al. | 343/909 X |

FOREIGN PATENT DOCUMENTS

| | | | |
|---|---|---|---|
| 86503 | 7/1981 | Japan | 333/202 |

OTHER PUBLICATIONS

Arnaud, J. A. and Ruscio, J. T.; "Resonant-Grid Quasi-optical Diplexer"; *Electronic Letters;* Dec. 13, 1973, vol. 9, No. 25; pp. 589-590.

Lee, C. K. and Langley, R. K.; "Equivalent Circuit Models for Frequency Selective Surfaces at Oblique Angles of Incidence"; *IEE Proceedings;* vol. 132, part H, No. 6, Oct. 85; pp. 395-398.

Langley and Parker; "Equivalent Circuit Model for Arrays of Square Loops"; *Electronics Letters;* Apr. 1, 1982, vol. 18, No. 7; pp. 294-296.

Marcuvitz, N.; *Waveguide Handbook;* McGraw Hill, 1951, pp. 280-284.

*Primary Examiner*—Eugene R. LaRoche

*Assistant Examiner*—Benny T. Lee

*Attorney, Agent, or Firm*—Steven M. Mitchell; Mark J. Meltzer; A. W. Karambelas

[57] ABSTRACT

A wideband frequency selective surface 10 is disclosed which includes a square grid 12 having a first plurality of parallel conductive lines perpendicularly intersecting a second plurality of parallel conductive lines to provide a plurality of squares. The distance between the parallel conductive lines is p. A plurality of conductive square loops 20-23 are included within the plurality of squares. The distance between each line segment of each square loop and the corresponding adjacent parallel conductive line segment of the square grid is g. The distance g is greater than one quarter times the distance p for wideband performance.

1 Claim, 1 Drawing Sheet

WIDEBAND GRIDDED SQUARE FREQUENCY SELECTIVE SURFACE

BACKGROUND OF THE INVENTION

1. Field of the Invention:

The present invention relates to microwave circuits. More specifically, the present invention relates to surfaces used to selectively pass microwave signals.

While the invention is described herein with reference to a particular embodiment for an illustrative application, it is understood that the invention is not limited thereto. Those having ordinary skill in the art and access to the teaching provided herein will recognize additional modifications, applications and embodiments within the scope thereof.

2. Description of the Related Art:

Some dual mode or multiple frequency band reflector antennas make use of frequency selective surfaces to direct microwave radiation from two or more feeds to the reflector of the antenna. The frequency selective surface is mounted generally parallel with the reflector between one feed with the second feed mounted between the surface and the reflector. In a transmit mode, microwave radiation from the first feed of a first frequency passes through the surface while radiation from the second feed of a second frequency is reflected by the surface to the reflector. The direction is reversed in the receive mode.

As is known in the art, frequency selective surfaces generally consist of arrays of conductive elements such as squares, circles, Jerusalem crosses, concentric rings or double squares supported by a dielectric substrate. Frequency selective surfaces are known to have several limitations. The passband of typical frequency selective surfaces is generally narrow. In addition, the conventional designs typically have slow rise and fall passband transitions.

The publication entitled "Equivalent-circuit models for frequency-selective surfaces at oblique angles of incidence"; by C. K. Lee and R. J. Langley; *IEE PROCEEDINGS*, Vol. 132, Pt. H, No. 6; October 1985; pp. 395–398 discloses a frequency selective surface consisting of a dielectric substrate containing an array of gridded-square printed circuit elements. The gridded-square array provides a frequency selective surface with sharp rise and fall passband transitions. However, the gridded-square frequency selective surface of Lee et al was apparently devised for separating two closely spaced and narrow frequency bands and accordingly does not appear to offer a wide passband.

There is therefore a need in the art for a wideband frequency selective surface suitable for spacecraft systems and other applications.

SUMMARY OF THE INVENTION

The need in the art is substantially addressed by the wideband frequency selective surface of the present invention. The wideband gridded square array frequency selective surface of the present invention includes a square grid having a first plurality of parallel conductive lines perpendicularly intersecting a second plurality of parallel conductive lines to provide a plurality of squares. The distance between the parallel conductive lines is p. A plurality of conductive square loops are disposed within the plurality of squares. The distance between each line segment of each square loop and the corresponding adjacent parallel conductive line segment of the square grid is g. A significant feature of the present invention is the fact that the gridded square array is designed so that the dimension g is greater than one quarter times said dimension p to provide for said wideband performance.

DESCRIPTION OF THE INVENTION

Figure 1:
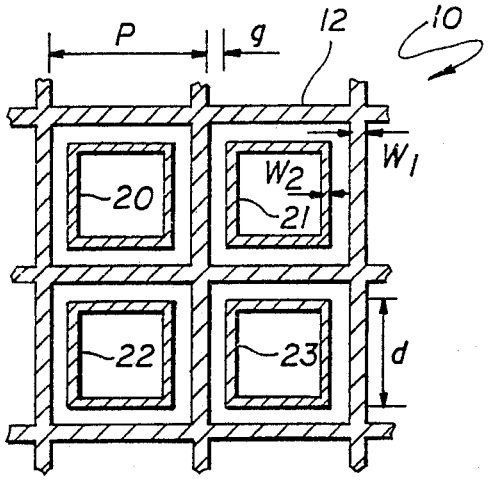
FIG. 1 shows a portion of a gridded-square array constructed in accordance with the teachings of the present invention.

A portion of a frequency selective surface constructed in accordance with the teachings of the present invention is shown in FIG. 1. The surface is provided by a gridded square array 10 which includes a first plurality of parallel conductive lines perpendicularly intersecting a second plurality of parallel conductive lines to provide a plurality of squares. The width of the conductive lines o the square grid 12 is $W_1$. The distance between the parallel conductive lines is p. A plurality of conductive square loops 20–23 are disposed on a substrate (not shown) within the plurality of squares. The width of the conductive lines of the square loop elements 20–23 is $W_2$. The distance between each line segment of each square loop and the corresponding adjacent parallel conductive line segment of the square grid is g.

As is known in the art, the square grid 12 and the square loops 20–23 may be etched on the substrate. The dielectric substrate may be Kapton or any other suitable material and the array elements may be copper or any other suitable conductive material.

In accordance with the teachings of the present invention, the dimensions of the elements of the gridded-square array 10 can be designed to provide a wide passband with the desired characteristics. In the illustrative embodiment, the distance g between each line segment of each square loop and the corresponding adjacent parallel conductive line segment of the square grid should be greater than one quarter times the distance p between the parallel conductive lines of the grid to provide for wideband performance.

Figure 2:
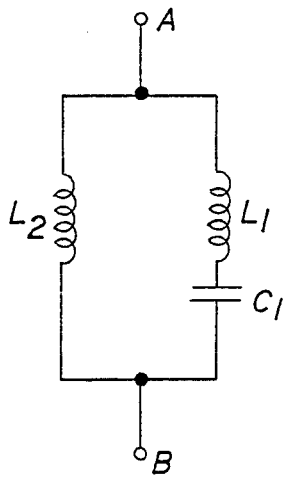
FIG. 2 is a schematic illustration of the equivalent circuit model of the gridded-square array of the present invention.

FIG. 2 provides a schematic illustration of the equivalent circuit model of the gridded-square array 10. As shown in FIG. 2, the equivalent circuit model of the gridded-square array 10 is the series pair of a first inductor, $L_1$, and a capacitor, $C_1$, in parallel with a second inductor, $L_2$. As is known in the art, the values of the components of the equivalent circuit model shown in FIG. 2 relate to the dimensions of the elements of the gridded-square array 10. An article in the *IEE PROCEEDINGS*. Vol. 132, Pt. H, No. 6, pp. 395–398 in October 1985 entitled "Equivalent-circuit models for frequency-selective surfaces at oblique angles of incidence" details the relationship between the gridded-square array elements and the components of the equivalent circuit model.

The reflection and transmission characteristics of a microwave signal applied to a frequency selective surface comprised of the gridded-square array 10 will be essentially the same as the reflection and transmission characteristics of a microwave signal applied to point A of the equivalent circuit model shown in FIG. 2 where the transmitted signal is that received at point B of the equivalent circuit model.

Figure 3:
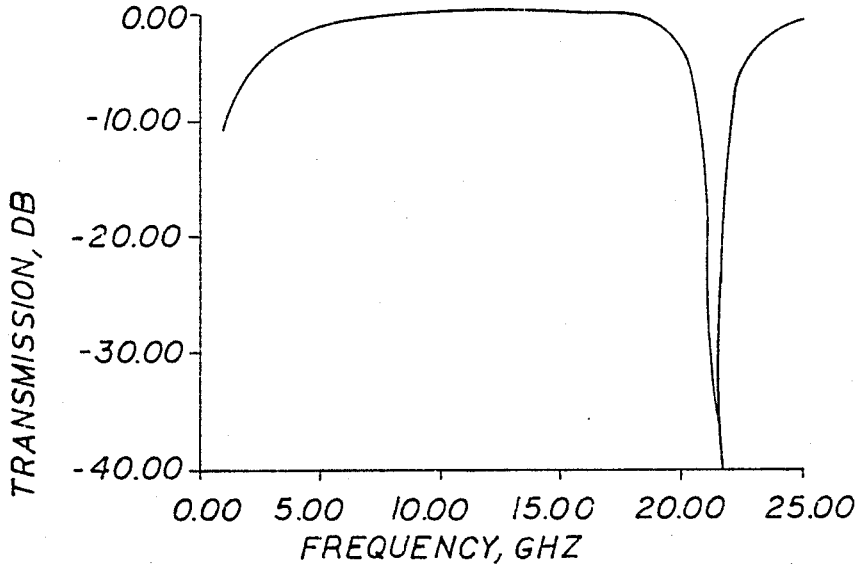
FIG. 3 shows the passband characteristics of a gridded-square frequency selective surface when constructed in accordance with the teachings of the present invention.

FIG. 3 shows the passband of the gridded-square array 10 of the present invention for dimension p equal to 0.446 inches, dimension $W_1$ equal to 0.006 inches, dimension $W_2$ equal to 0.014 inches, dimension d equal to 0.154 inches and dimension g equal to 0.143 inches. As shown in FIG. 3, the transmission bandwidth for a frequency selective surface using the gridded-square array 10 of the present invention with the above mentioned dimensions is from approximately 6 to 19 GHz, which is approximately a 3.2:1 passband ratio. Those skilled in the art and with access to the teachings of the present invention will recognize that the dimensions of the elements of the gridded-square array 10 may be modified to provide a wideband gridded-square frequency selective surface with the desired characteristics without departing from the scope of the present invention.

While the present invention has been described herein with reference to an illustrative embodiment and a particular application, it is understood that the invention is not limited thereto. Those having ordinary skill in the art and access to the teachings of the present invention will recognize additional modifications and applications within the scope thereof.

For example, by scaling the dimensions of the elements of the gridded-square array 10, the present invention can be used for any 3.2 to 1 band pass applications in the microwave frequency range.

It is therefore intended by the appended claims to cover any and all such modifications, applications and embodiments.

Accordingly,

What is claimed is:

1. A wideband gridded square array frequency selective surface comprising:

a square grid formed by a first plurality of parallel conducive lines spaced apart at a distance p, said first plurality of parallel conducting lines perpendicularly intersecting a second plurality of parallel conductive liens spaced apart at a distance p to provide a plurality of squares therebetween and a plurality of conductive square loops, each square loop of said plurality of square loops being disposed within an associated one of said squares of said grid such that a distance g between a respective line segment of said square loop and the corresponding adjacent parallel conductive line segment of said first grid is greater than one quarter times said distance p between said parallel lines of said grid.

* * * * *